United States Patent [19]

Komiyama et al.

[11] 4,344,837

[45] Aug. 17, 1982

[54] PROCESS FOR THE DEHYDRATION AND LIQUEFACTION OF WATER-CONTAINING COAL

[75] Inventors: Tadashi Komiyama, Yokohama; Shoichi Oi; Noriaki Ohnishi, both of Ohmuta; Shinya Mori, Kurume; Tadanobu Takata, Aaro; Isao Kubo, Tokyo, all of Japan

[73] Assignee: Mitsui Coke Co., Ltd., Japan

[21] Appl. No.: 248,693

[22] Filed: Mar. 30, 1981

[30] Foreign Application Priority Data

Apr. 15, 1980 [JP] Japan ..... 55-48717
Apr. 18, 1980 [JP] Japan ..... 55-50330

[51] Int. Cl.[3] ..... C10G 1/00
[52] U.S. Cl. ..... 208/8 LE
[58] Field of Search ..... 208/8 LE

[56] References Cited

U.S. PATENT DOCUMENTS 3,488,279 1/1970 Schulman ..... 208/8 LE X
3,503,865 3/1970 Stone ..... 208/8 LE X
4,248,691 2/1981 Eisenlohr ..... 208/8 LE

FOREIGN PATENT DOCUMENTS 507675 11/1954 Canada ..... 208/8 LE
2602098 7/1976 Fed. Rep. of Germany ... 208/8 LE

*Primary Examiner*—Delbert E. Gantz
*Assistant Examiner*—William G. Wright
*Attorney, Agent, or Firm*—McGlew and Tuttle

[57] ABSTRACT

In a process wherein a slurry of water-containing coal and a solvent is heated to 100°–350° C. and then subjected to vapor-liquid separation by which water vapor is separated from the slurry to obtain a dehydrated slurry, a slurry to be dehydrated is mixed with a part of the dehydrated slurry and then heated. The dehydrated slurry thus obtained is suitable for use as a starting material for the hydrogenolysis of coal.

10 Claims, 2 Drawing Figures

PROCESS FOR THE DEHYDRATION AND LIQUEFACTION OF WATER-CONTAINING COAL

BACKGROUND OF THE INVENTION (1) Field of the Invention

This invention relates to improvements in a process for the dehydration of water-containing coal by heating a slurry of the water-containing coal and a solvent, or improvement in a process for the preparation of a slurry of dehydrated coal and a solvent. It also relates to the use of a slurry of dehydrated coal so prepared as a starting material for the liquefaction of coal and to an improved process for the liquefaction of water-containing coal.

(2) Description of the Prior Art

After being mined, coal is subjected to a coal preparation process for removing ash as completely as possible. This coal deashing process is usually carried out by use of water, and the separation efficiency becomes higher as the particle size of the coal is reduced. However, the amount of adhesive moisture contained in the deashed coal increases in inverse proportion to the particle size of the coal. Usually, this adhesive moisture amounts to 20% or more. Moreover, some kinds of brown coal have a water content of as high as 20–65%.

Among the well-known methods for drying such water-containing coal are (a) flash drying and (b) drying in oil. Flash drying is being employed in East Germany, Australia and the like, but has the disadvantage that the coal is oxidized in the course of drying. Oxidized coal is subject to spontaneous ignition and its storage involves considerable difficulty. Moreover, when used as a starting material for the liquefaction of coal, such oxidized coal gives only a low degree of dissolution and causes an increase in the hydrogen consumption which has an important influence on the economical efficiency of the coal liquefaction process. On the other hand, drying in oil causes no oxidation of the coal. A number of prior art methods based on the principle of drying in oil are disclosed in Japanese Patent Laid-Open Nos. 112902/'78, 125406/'78 and 66904/'79. According to any of these methods, however, the dehydrated coal still has a water content of about 10%. When the coal so treated is transported as fuel, such a high water content uneconomically causes an increase in transport cost. Moreover, when the coal so treated is used as a starting material for the liquefaction of coal, the decrease in the net supply of coal causes a reduction in equipment capacity and the increase in the partial pressure of water vapor causes a decrease in the partial pressure of hydrogen. As a result, the coal liquefaction equipment need have higher pressure resistance and hence involves uneconomically increased costs.

SUMMARY OF THE INVENTION

It is an object of the present invention to provide an improved process for the dehydration of water-containing coal on the principle of drying in oil.

It is another object of the present invention to provide a process for the dehydration of water-containing coal which can reduce its water content to a very low level.

It is a further object of the present invention to provide a process for the preparation of a slurry of dehydrated coal and a solvent which slurry is suitable for use as a starting material for the liquefaction of coal and the use of such a slurry of dehydrated coal as a starting material for the liquefaction of coal.

It is a still further object of the present invention to provide an improved process for the liquefaction of water-containing coal.

The above and other objects of the present invention are accomplished by the following process:

In a process for the dehydration of water-containing coal wherein a slurry of the water-containing coal and a solvent is heated to a temperature in the range of from 100° to 350° C. and the heated slurry is subjected to vapor-liquid separation by which a gas mixture including water vapor is separated from the dehydrated slurry, the improvement which comprises mixing a part of the dehydrated slurry with an undehydrated slurry of the water-containing coal and the solvent and dehydrating the resulting mixed slurry by heating it to said temperature.

The dehydrated slurry thus obtained can be used in a conventional process for the liquefaction of coal, where it is heated under an elevated pressure of hydrogen to form a coal solution. Thereafter, the solvent and various depolymerization products of the coal are recovered from this coal solution.

DETAILED DESCRIPTION OF THE INVENTION

The water-containing coal used in the present invention can be any type of coal that has a water content of not less than 10% by weight, and specific examples thereof include caking coal, non-caking coal, brown coal, lignite and grass peat.

The solvent used for the preparation of a slurry of water-containing coal is a hydrocarbon oil having a boiling point of 180° C. or above, and specific examples thereof include tar obtained by the carbonization of coal or its fractions, heavy petroleum oils having a boiling point of 200° C. or above, the oily decomposition product of coal produced in the liquefaction of coal, the hydrogenation products of these solvents, and mixtures of the foregoing.

The weight ratio of water-containing coal to solvent preferably ranges from 1:0.7 to 1:10 and more preferably from 1:1 to 1:4. The amount of dehydrated slurry mixed with an undehydrated slurry of water-containing coal and a solvent is preferably not less than 0.2 parts by weight and more preferably from 0.5 to 10 parts by weight per part by weight of the undehydrated slurry. If the amount of dehydrated slurry mixed therewith is less than 0.2 part by weight, the degree of dehydration of the water-containing coal is unduly low, while if it is greater than 10 parts by weight, the capacity of the equipment for dehydrating the water-containing coal is decreased to an uneconomical extent.

Figure 1:
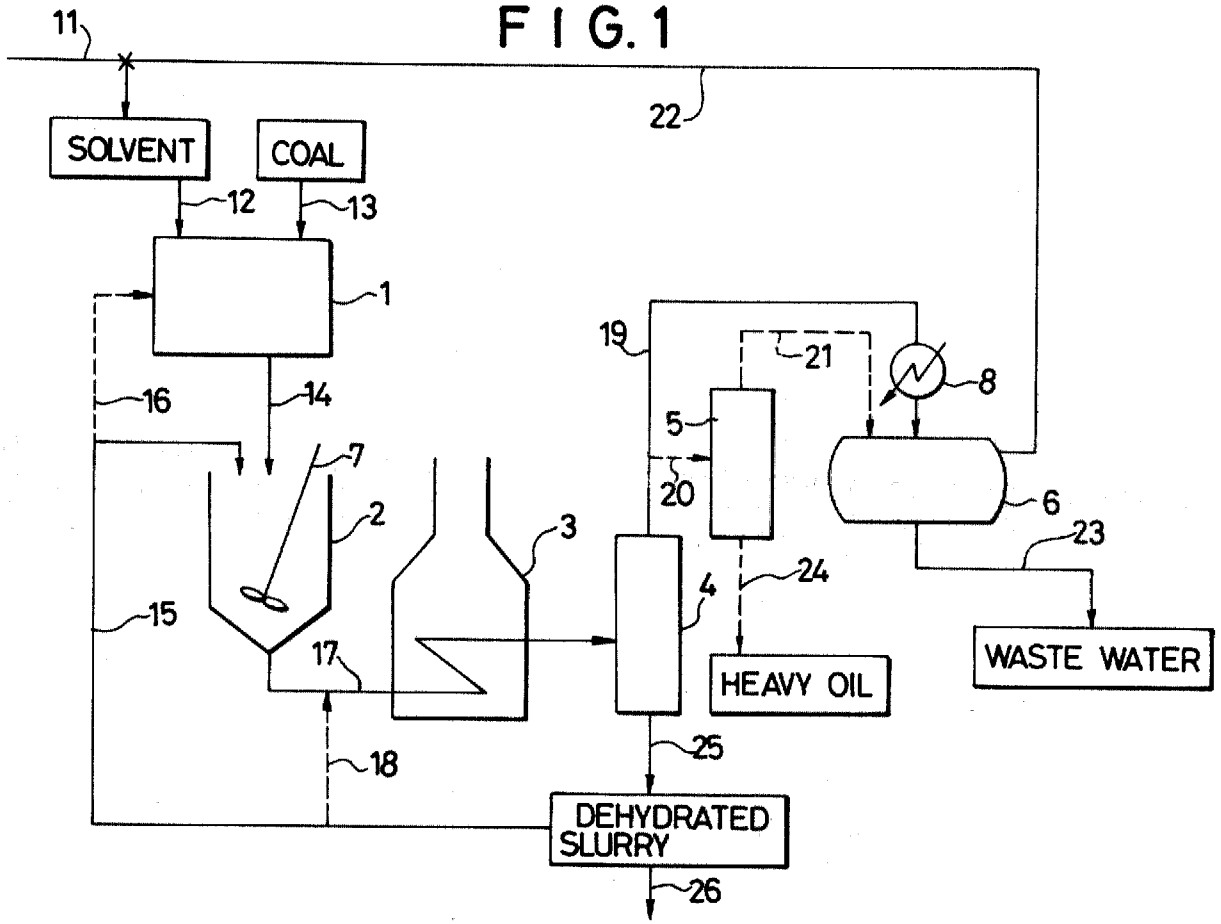
FIG. 1 is a flow sheet illustrating one embodiment of the dehydration process of the present invention.

Now, one embodiment of the dehyration process of the present invention is described with reference to FIG. 1. A solvent and water-containing coal are introduced through the respective lines 12 and 13 into a grinding machine 1, where the coal is finely ground and mixed with the solvent to form a slurry consisting of the water-containing coal and the solvent. The grinding machine 1 can be any suitable type of pulverizer such as a ball mill, a tower mill or the like. Where a ball mill is used as grinding machine 1, the slurry contains air bubbles which, during its pumping, may cause cavitation damage to the pump. Accordingly, it is preferable that the slurry withdrawn from the ball mill is conducted through a line 14 into a slurry tank 2 equipped with an agitator 7 and deaerated to remove the aforesaid air bubbles. In this case, it is convenient for the deaeration to warm the slurry to a temperature in the range of from 30° to 50° C. Although the time required for the deaeration depends on the properties of the slurry, it generally ranges from about 1 to 3 hours. On the other hand, where a tower mill or the like is used as grinding machine 1, the slurry scarcely contains air bubbles and generally requires no deaeration. However, it is also preferable to warm the slurry to a temperature in the range of from 30° to 50° C. for the purpose of decreasing the pump load. In order to warm the slurry, the vapor phase (including water vapor) or dehydrated slurry which will be described later may be utilized as a heat source. Heating of the slurry to a temperature higher than 50° C. is undesirable because air bubbles are formed in the slurry. The slurry so prepared is mixed with a dehydrated slurry which is introduced through a line 15 into slurry tank 2. However, the dehydrated slurry may be introduced through a line 16 into grinding machine 1, or may be conducted through a line 18 and mixed with the undehydrated slurry being transferred from slurry tank 2 to a heating furnace 3.

The mixed slurry of the undehydrated slurry and the dehydrated slurry is pressurized by means of a pump (not shown) and conducted through a line 17 into heating furnace 3, where it is heated to a temperature in the range of from 100° to 350° C. and preferably from 130° to 250° C. If the heating temperature is lower than 100° C., the degree of dehydration is unduly low, while it is higher than 350° C., the pressure is too high for an economical operation. In order to prevent the occurrence of coking, it is generally suitable to employ a pressure approximately equal to or higher than the saturated vapor pressure of water at the temperature of the heated slurry. If a pressure significantly lower than the saturated vapor pressure of water is employed, the heating furnace shows a tendency toward coking. In such a case, it is preferable that the slurry is not heated directly in a heating furnace, but in a heat exchanger or the like with the aid of a heating medium. The heat source used for this purpose can be the vapor phase (including water vapor) obtained from the process of the present invention, whether as such or after being compressed.

After being heated, the mixed slurry is conducted through a pressure regulating valve (not shown) into a vapor-liquid separator 4, where it is separated into a vapor phase containing steam and a dehydrated slurry. The vapor phase is conducted through a line 19, cooled in a condenser 8, and thereafter introduced into an oil-vapor separator 6. This condenser 8 can be utilized as a heat exchanger for transferring heat from the vapor phase to the mixed slurry which has not yet been dehydrated. Alternatively, the vapor phase may be conducted through a line 20 into a distillation apparatus 5, where heavy oil is separated from light oil and water. The resulting mixture of light oil and water is then conducted through a line 21 into oil-water separator 6. In oil-water separator 6, the condensate can be separated into water and a solvent by keeping its temperature at about 80° C. The resulting solvent is conducted through a line 22 and mixed with the fresh solvent supplied through line 11, while the resulting water is discharged through a line 23. Where the vapor phase is passed through distillation apparatus 5, the heavy oil obtained as the bottoms can be recovered through a line 24, thus facilitating the separating operation in oil-water separator 6. On the other hand, the dehydrated slurry separated in vapor-liquid separator 4 is conducted through a line 25 and a part thereof is returned through line 15, 16 or 18 to grinding machine 1, slurry tank 2 or line 17. The remainder of the dehydrated slurry is withdrawn through a line 26 and can be used directly as fuel or a starting material for the liquefaction of coal.

Figure 2:
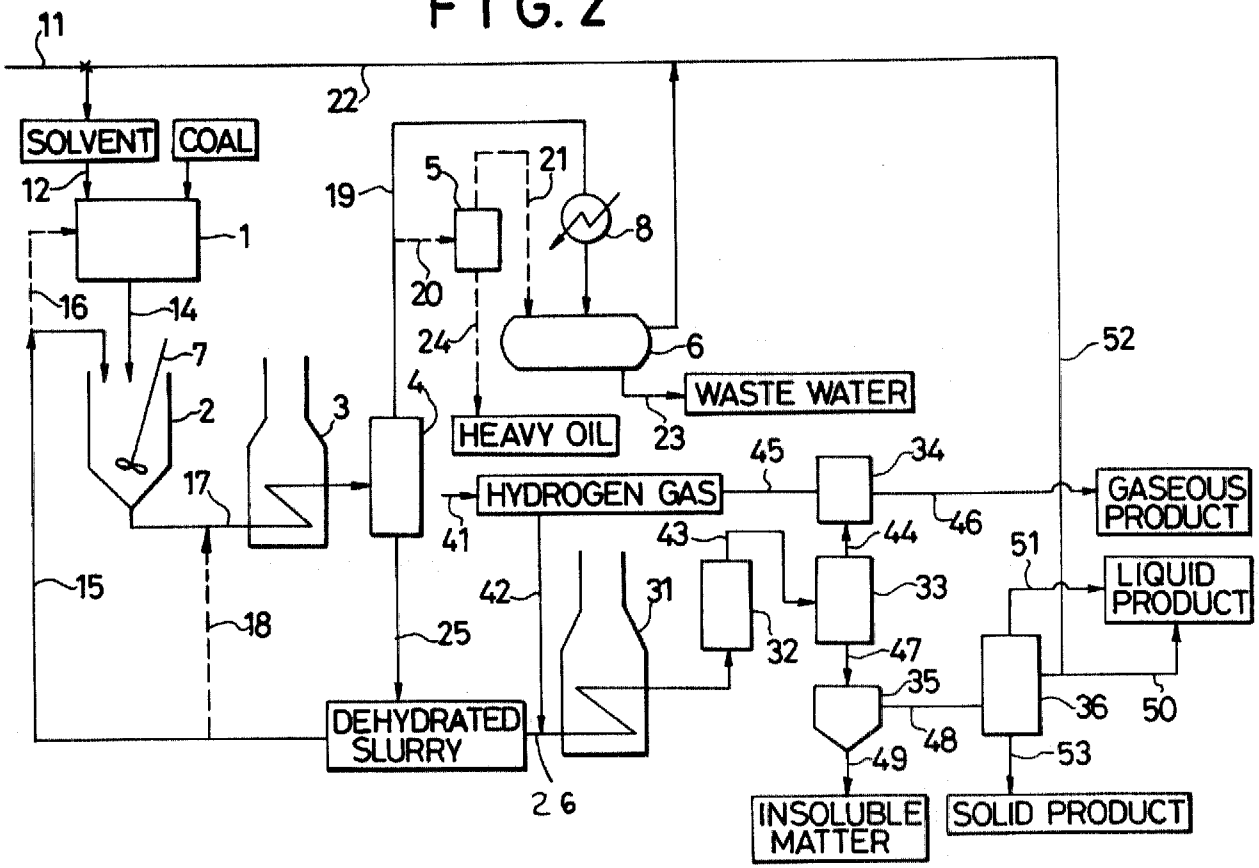
FIG. 2 is a flow sheet illustrating one embodiment of the process for the liquefaction of water-containing coal according to the concept of the present invention.

Now, one embodiment of the process for the liquefaction of coal by using the dehydrated coal prepared according to the present invention is described with reference to FIG. 2. In this process, the dehydration of a slurry of water-containing coal and a solvent is carried out in all the same manner as described with reference to FIG. 1. While a part of the dehydrated slurry is mixed with an undehydrated slurry for the purpose of its dehydration, the remainder of the dehydrated slurry is partially or totally conveyed through a line 26 by means of a pump (not shown), during which hydrogen gas supplied through a line 42 is added thereto so as to give a hydrogen partial pressure of not lower than 30 atmospheres and preferably from 70 to 300 atmospheres. Then, the dehydrated slurry is passed through a dehydrated slurry heating furnace 31. In this dehydrated slurry heating furnace 31, the dehydrated slurry is heated to a temperature in the range of from 300° to 500° C. and preferably from 400° to 470° C. and then introduced into a reactor 32. The residence time in reactor 32 is determined so that the slurry will come to have such a viscosity as to permit easy filtration. Preferably, the residence time ranges from 10 to 120 minutes. In this reactor 32, the coal is depolymerized and dissolved in the solvent to form a coal solution.

After leaving reactor 32, the coal solution is conducted through a line 43 into a coal solution-gas separator 33, where a gas mixture including hydrogen, gaseous hydrocarbons, carbon dioxide, hydrogen sulfide and the like is separated from the coal solution. The separated gas mixture is conducted through a line 44 into a gas separator 34. In this gas separator 34, carbon dioxide and hydrogen sulfide are removed, for example, by washing the gas mixture with an aqueous alkaline solution, and gaseous hydrocarbons are removed, for example, by cooling the gas mixture to condense the hydrocarbons, whereby the unconsumed hydrogen gas is recovered. The recovered hydrogen gas is conducted through a line 45, mixed with the fresh hydrogen gas supplied through line 41, and then added through line 42 to the dehydrated slurry which is to be subjected to hydrogenolysis as described above. In this case, however, the removal of gaseous hydrocarbons can be omitted. The separated carbon dioxide and hydrogen sulfide are subjected to a step (not shown) for recovering these gases, if necessary, and then discharged through a line 46.

On the other hand, the coal solution separated in coal solution-gas separator 33 is introduced through a line 47 into a solid-liquid separator 35, where insoluble matter including undecomposed coal, ash and the like is separated. This solid-liquid separator 35 can be of any suitable type. For example, a filter, a centrifuge, a liquid cyclone, or a solid-liquid separator based on a solvent treatment process such as the Lummus process can be used for this purpose. The separated insoluble matter is discharged through a line 49.

After being freed of insoluble matter in solid-liquid separator 35, the coal solution is introduced through a line 48 into an evaporator 36. Thus, the solvent and a coal liquefaction product that is a liquid at ordinary temperatures are recovered through lines 50 and 51, respectively. Usually, the solvent is conducted through lines 52 and 22 and recycled to the process for the preparation of a coal slurry. On the other hand, a coal liquefaction product that is a solid at ordinary temperatures is obtained as the residue and recovered through a line 53.

According to the dehydration process of the present invention, water-containing coal having a water content of not less than 60% by weight can readily be dehydrated to a water content of not greater than 5% by weight, thus making it possible to reduce the equipment cost and other costs required for the liquefaction of the coal. Such a high degree of dehydration is attributable to the fact that the slurry to be dehydrated according to the present invention comprises a combination of an undehydrated slurry of water-containing coal and a solvent) and a dehydrated slurry. In this case, the dehydrated slurry serves not only to apparently reduce the water content of the mixed slurry obtained by mixing it with the undehydrated slurry, but also to enhance the degree of dehydration thereof.

Moreover, the coal present in the resulting dehydrated slurry has such good dispersibility that its particles scarcely settle down. Accordingly, this dehydrated slurry can readily be conveyed and used as the so-called COM (i.e., mixed fuel of coal and oil). Furthermore, owing to its high degree of dehydration, this dehydrated slurry is also suitable for use a starting material for the liquefaction of coal.

When the dehydrated slurry prepared according to the present invention is liquefied, the degree of liquefaction is higher than has been achievable in the prior art. This is not only due to the fact that oxidation of the coal is prevented by dehydrating it in a solvent, but also to the fact that the dehydration is carried out at a temperature of 100° C. or above and a part of the resulting dehydrated slurry is recycled. That is, the degree of liquefaction of coal is considered to be enhanced because the solvent penetrates into the coal during its heating at a temperature of 100° or above for a long period of time.

The present invention will be more fully understood by reference to the following examples. However, these examples are intended merely to illustrate the practice of the invention and are not to be construed to limit the scope of the invention.

EXAMPLE 1

Using a ball mill, 40 kg of Australian brown coal (having a water content of 60% by weight) was finely ground and intimately mixed with 60 kg of a solvent derived from coal to form a slurry. This slurry was introduced into a slurry tank and deaerated by warming it to 30° C. Then, the slurry was pressurized to 45 kg/cm$^2$G by means of a pump and passed through a heating furnace. After being heated to 250° C. in the heating furnace, the slurry was introduced through a reducing valve into a vapor-liquid separator, where it was separated into a vapor phase and a dehydrated slurry. Because of its low degree of dehydration, all of the dehydrated slurry was returned to the slurry tank, heated to 200° C. under a pressure of 20 kg/cm$^2$G, and then introduced through the reducing valve into the vapor-liquid separator. Thus, a dehydrated slurry having a water content of 1.8% by weight was obtained. The brown coal present in this dehydrated slurry had a water content of 7.4% by weight.

Then, 50 kg of an undehydrated slurry as described above and 50 kg of the dehydrated slurry (having a water content of 1.8% by weight) prepared according to the abovedescribed procedure were introduced into the slurry tank and deaerated by warming them to 30° C. The resulting mixed slurry had a water content of 12.9% by weight. This mixed slurry was dehydrated by heating it to 235° C. under a pressure of 35 kg/cm$^2$G. The resulting dehydrated slurry had a water content of 1.1% by weight, and the brown coal present in this dehydrated slurry had a water content of 4.7% by weight.

COMPARATIVE EXAMPLE 1

Using a ball mill, 21.5 kg of the same brown coal as used in Example 1 was finely ground and intimately mixed with 78.5 kg of the same solvent as used in Example 1 to form a slurry having a water content of 12.9% by weight. According to the same procedure as described in Example 1, this slurry was dehydrated by heating it to 235° C. under a pressure of 35 kg/cm$^2$G. The resulting dehydrated slurry had a water content of 2.5% by weight, and the brown coal present in this dehydrated slurry had a water content of 15.7% by weight.

As is evident from Example 1 and Comparative Example 1, the process of the present invention in which a mixed slurry consisting of an undehydrated slurry and a dehydrated slurry is dehydrated by the application of heat can bring about a marked enhancement in the degree of dehydration, as compared with the prior art process in which an undehydrated slurry alone is dehydrated by the application of heat.

EXAMPLE 2

Using the same equipment as in Example 1, a mixed slurry consisting of 25 kg of the same undehydrated slurry as used in Example 1 and 45 kg of the same dehydrated slurry (having a water content of 1.8% by weight) as used in Example 1 was dehydrated by heating it to 200° C. under a pressure of 20 kg/cm$^2$G. The resulting dehydrated slurry had a water content of 1.1% by weight, and the brown coal present in this dehydrated slurry had a water content of 4.6% by weight.

EXAMPLE 3

Using the same equipment as in Example 1, a mixed slurry consisting of 60 kg of the same undehydrated slurry as used in Example 1 and 40 kg of the same dehydrated slurry (having a water content of 1.8% by weight) as used in Example 1 was dehydrated by heating it to 155° C. under a pressure of 2 kg/cm$^2$G. The resulting dehydrated slurry had a water content of 0.6% by weight, and the brown coal present in this dehydrated slurry had a water content of 2.5% by weight.

EXAMPLE 4

Using a ball mill, 40 kg of Australian brown coal (having a water content of 60% by weight) was finely ground and intimately mixed with the liquid product resulting from the coal liquefaction process which will be described later. The resulting slurry had a water content of 24% by weight and a brown coal content of 16% by weight (on a water-free basis). Then, 50 kg of this undehydrated slurry and 50 kg of the dehydrated slurry resulting from the dehydration process being described [which dehydrated slurry had a water content of 1.5% by weight and a brown coal content of 22.5% by weight (on a water-free basis)] were introduced into a slurry tank and mixed together to form a mixed slurry. At the same time, this mixed slurry was deaerated by warming it to 30° C. Then, the mixed slurry was pressurized to 35 kg/cm$^2$G by means of a pump and passed through a heating furnace at a rate of 30 kg/hr. After being heated to 235° C. in this heating furnace, the mixed slurry was introduced through a reducing valve into a vapor-liquid separator, where it was separated into a vapor phase and a dehydrated slurry. This dehydrated slurry had a water content of 1.1% by weight and a brown coal content of 22.5% by weight, and the brown coal present therein had a water content of 4.7% by weight. Thereafter, the dehydrated slurry was pressurized by means of pump, and hydrogen gas was added thereto so as to give a hydrogen partial pressure of 150 kg/cm$^2$G. Then, the dehydrated slurry was passed through a dehydrated slurry heating furnace at a rate of 2 kg/hr. After being heated to 450° C. in this dehydrated slurry heating furnace, the dehydrated slurry was allowed to stay in a reactor for an hour. The resulting dissolution product was reduced in pressure and then introduced into a coal solution-gas separator, where a gas mixture was separated. Thereafter, the resulting coal solution was introduced into a solid-liquid separator to remove any undecomposed coal and ash by filtration, and then subjected to a treatment in an evaporator to obtain a liquid product, the solvent and a solid liquefaction product that was a solid at ordinary temperatures. In this example, the degree of dissolution of the brown coal was 85.2% by weight (on a water-free and ash-free basis).

COMPARATIVE EXAMPLE 2

The same brown coal as used in Example 4 was previously dried in a vacuum dryer to obtain dry brown coal having a water content of 6.2% by weight. Then, 22.5 kg of this dry brown coal was mixed with 77.5 kg of the same liquid product as used in Example 4 to form a slurry. Instead of being dehydrated, this slurry was directly pressurized by means of a pump, and hydrogen gas was added thereto so as to give a hydrogen partial pressure of 150 kg/cm$^2$G. Then, the dehydrated slurry was passed through a dehydrated slurry heating furnace at a rate of 2 kg/hr. Thereafter, the brown coal was dissolved by repeating the procedure of Example 4. As a result, the degree of dissolution of the brown coal was 81.6% by weight.

COMPARATIVE EXAMPLE 3

The same brown coal as used in Example 4 was dried in air at 110° C. for an hour to obtain dry brown coal having a water content of 5.3% by weight. Similarly to Comparative Example 2, hydrogen gas was added to a slurry of this brown coal so as to give a hydrogen partial pressure of 150 kg/cm$^2$G. Then, the slurry was heated to 450° C. and allowed to stay in a reactor for an hour. As a result, the degree of dissolution of the brown coal was 76.8% by weight.

As is evident from Example 4 and Comparative Examples 2 and 3, the process for the liquefaction of water-containing coal in accordance with the present invention can provide a much higher degree of dissolution than the cases in which brown coal dried in a vacuum (Comparative Example 2) or in air (Comparative Example 3) is liquefied. Thus, the coal liquefaction process of the present invention is much superior in this respect to prior art processes.

EXAMPLE 5

Using the same equipment as in Example 4, a mixed slurry consisting of 50 kg of the same undehydrated slurry as used in Example 4 and 90 kg of the same dehydrated slurry as used in Example 4 was dehydrated by heating it to 200° C. under a pressure of 20 kg/cm$^2$G. The resulting dehydrated slurry had a water content of 1.1% by weight and a brown coal content of 22.8% by weight, and the brown coal present therein had a water content of 4.6% by weight. Similarly to Example 4, hydrogen gas was added to this dehydrated slurry so as to give a hydrogen partial pressure of 150 kg/cm$^2$G. Then, the dehydrated slurry was heated to 450° C. and allowed to stay in a reactor for an hour. As a result, the degree of dissolution of the brown coal was 86.7% by weight.

EXAMPLE 6

Using the same equipment as in Example 4, a mixed slurry consisting of 60 kg of the same undehydrated slurry as used in Example 4 and 40 kg of the same dehydrated slurry as used in Example 4 was dehydrated by heating it to 155° C. under a pressure of 2 kg/cm$^2$G. The resulting dehydrated slurry had a water content of 0.6% by weight and a brown coal content of 23.0% by weight, and the brown coal present therein had a water content of 2.5% by weight. Similarly to Example 4, hydrogen gas was added to this dehydrated slurry so as to give a hydrogen partial pressure of 150 kg/cm$^2$G. Then, the dehydrated slurry was heated to 450° C. and allowed to stay in a reactor for an hour. As a result, the degree of dissolution of the brown coal was 84.5% by weight.

What is claimed is:

1. In a process for the dehydration of water-containing coal wherein a slurry of the water-containing coal and a solvent is heated to a temperature in the range of from 100° to 350° C. and the heated slurry is subjected to vapor-liquid separation by which a gas mixture including water vapor is separated from the dehydrated slurry, the improvement which comprises mixing a part of the dehydrated slurry with an undehydrated slurry of the water-containing coal and the solvent and dehydrating the resulting mixed slurry by heating it to said temperature.

2. The process according to claim 1 wherein at least 0.2 part by weight of the dehydrated slurry is mixed with 1 part by weight of the undehydrated slurry of the water-containing coal and the solvent.

3. The process according to claim 2 wherein from 0.5 to 10 parts by weight of the dehydrated slurry is mixed with 1 part by weight of the undehydrated slurry of the water-containing coal and the solvent.

4. The process according to claim 2 wherein the weight ratio of the water-containing coal to the solvent ranges from 1:0.7 to 1:10.

5. The process according to claim 4 wherein the weight ratio of the water-containing coal to the solvent ranges from 1:1 to 1:4.

6. The process according to claim 2 wherein the water-containing coal is caking coal, non-caking coal, brown coal, lignite or grass peat which has a water content of not less than 10% by weight.

7. The process according to claim 2 wherein the solvent is a hydrocarbon oil having a boiling point of 180° C. or above.

8. The process according to claim 2 wherein the mixed slurry is heated under a pressure equal to or higher than the saturated vapor pressure of water at the temperature of the mixed slurry after being heated.

9. The use of a dehydrated slurry of dehydrated coal and a solvent as a starting material for the liquefaction of coal, the dehydrated slurry being prepared by the process according to any one of claims 1 to 8.

10. In a process for the liquefaction of coal wherein a slurry of water-containing coal and a solvent is heated to a temperature in the range of from 100° to 350° C., the heated slurry is subjected to vapor-liquid separation by which a gas mixture including water vapor is separated from the dehydrated slurry, and the dehydrated slurry is heated under an elevated pressure of hydrogen to depolymerize the coal and dissolve it in the solvent, the improvement which comprises mixing a part of the dehydrated slurry with an undehydrated slurry of the water-containing coal and the solvent and dehydrating the resulting mixed slurry by heating it to said temperature.

* * * * *